United States Patent [19]

Hagman

[11] Patent Number: 4,516,704

[45] Date of Patent: May 14, 1985

[54] HOSIERY DONNING AID

[76] Inventor: Harry C. Hagman, 6122 Portland Ave. South, Minneapolis, Minn. 55417

[21] Appl. No.: 631,217

[22] Filed: Jul. 16, 1984

[51] Int. Cl.[3] ..... A47J 51/06

[52] U.S. Cl. ..... 223/111

[58] Field of Search ..... 223/111, 112, 113, 114, 223/115, 116, 117, 118, 119

[56] References Cited

U.S. PATENT DOCUMENTS

| | | | |
|---|---|---|---|
| 2,443,115 | 6/1948 | Park | 223/111 |
| 3,727,812 | 4/1973 | Weiss | 223/111 |
| 4,072,255 | 2/1978 | Bogorad | 223/111 |
| 4,130,226 | 12/1978 | Farrell | 223/111 |

*Primary Examiner*—Louis K. Rimrodt
*Assistant Examiner*—J. L. Kravitz
*Attorney, Agent, or Firm*—Burd, Bartz & Gutenkauf

[57] ABSTRACT

A simple device for aiding the infirm in donning hosiery. The hosiery donning aid comprises a rigid hoop and a handle. The hoop is of a size sufficiently large to permit it to fit loosely over the foot. The handle is secured to one side of the hoop and permits a sock or stocking held loosely engaged over the outside surface of the hoop to be maneuvered onto the user's foot. Preferably the handle is telescopic and pivotally secured to the inside of the hoop. The handle may be separable from the hoop.

2 Claims, 4 Drawing Figures

HOSIERY DONNING AID

BACKGROUND OF THE INVENTION

1. Field of the Invention

This invention is directed to a device for aiding the physically handicapped, the elderly, or other infirm persons who, because they have difficulty bending over, need assistance in putting on their hosiery.

2. The Prior Art

One device on the market for aiding in the donning of hosiery comprises an open topped and open ended semi-rigid trough having cloth tapes attached to one end. The open end of the sock or stocking to be donned is stretched over the end of the trough opposite from the cloth tapes. The foot is inserted in the trough and the hosiery is pulled into place by pulling on the cloth tapes, after which the plastic trough is withdrawn.

Another form of device comprises a semi-rigid flat plastic sheet about 3 to 4 inches wide and about 18 to 24 inches long bent transversely at an obtuse angle of about 120°–135°. Flexible cords are secured to one end of the device. A semi-rigid sleeve open at the top is secured to the other end of the device. The open end of the hosiery to be donned is pulled over the guide sleeve and the hosiery is pulled up with the cords.

Both of these known prior art devices are cumbersome and difficult to use. The hosiery donning aid of the present invention represents a structurally distinct improvement over the prior art devices.

SUMMARY OF THE INVENTION

Broadly stated the device of the present invention for aiding the infirm in donning hosiery comprises a rigid hoop of a size sufficiently large to permit the user's foot to fit loosely therein. The hoop has smooth inner and outer surfaces. The outer surface is engageable by the stretched open top end of a sock or stocking to be donned. A slender rigid elongated handle is secured to one side of the hoop. Preferably the handle is pivotally secured to the hoop. Desirably the handle is also telescopic and of a collapsed length less than the diameter of the hoop such that it may be pivotally secured to the inside surface of the hoop and folded within the confines of the hoop for storage. The hoop may be of adjustable diameter.

BRIEF DESCRIPTION OF THE DRAWINGS

The invention is illustrated by the accompanying drawings wherein corresponding parts are identified by the same numerals and in which.

DETAILED DESCRIPTION OF THE PREFERRED EMBODIMENT

Figure 1:
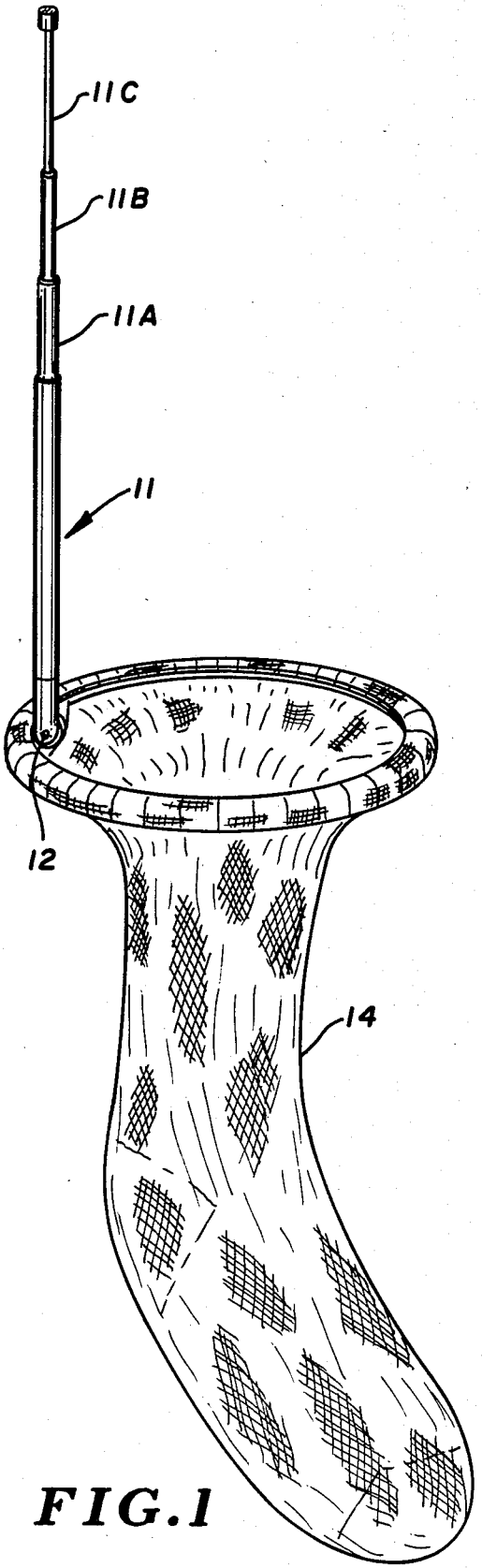
FIG. 1 is a perspective view of the hosiery donning aid with a sock attached and with its handle partially extended.

Referring now to the drawings, the hosiery donning aid of the present invention comprises a closed rigid hoop, shown generally at 10, and a slender rigid elongated handle, indicated generally at 11, secured to one side of the hoop. The hoop 10 is preferably circular, although it may be oval or ovoid. It may be formed, for example, from wood, synthetic resinous plastic material, metal, or the like. It must have a diameter of a size sufficiently large that the foot of the user may be easily inserted therein with a loose roomy fit. The diameter may be fixed, or it may be adjustable. Adjustable diameter steel band clamps are readily available and may be used. The inside surface of the hoop should be smooth such that it does not scratch or otherwise injure the foot of the user. The outside surface should also be smooth such that the hoop may be readily withdrawn from a sock or stocking temporarily secured to the hoop. Typically the hoop should be from about 4½ to 6 inches in diameter.

The handle 11 is slender and elongated. Its length should be sufficient to permit the user to position hosiery on the foot without bending over. Typically the handle should be about 16 to 24 inches long. The handle likewise may be formed from wood or synthetic resinous plastic material or metal, or the like.

Figure 2:
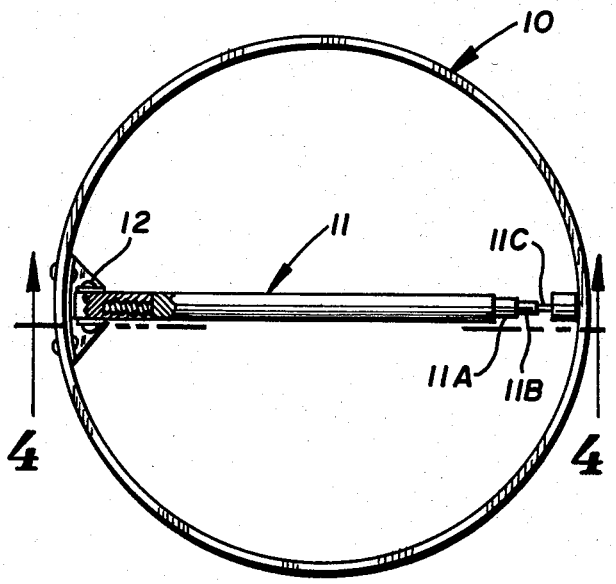
FIG. 2 is a top plan view of the preferred form of the hosiery donning aid, partly in section to show a detachable form of handle.
Figure 3:
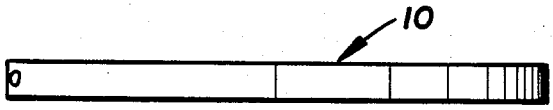
FIG. 3 is a side elevation thereof.
Figure 4:
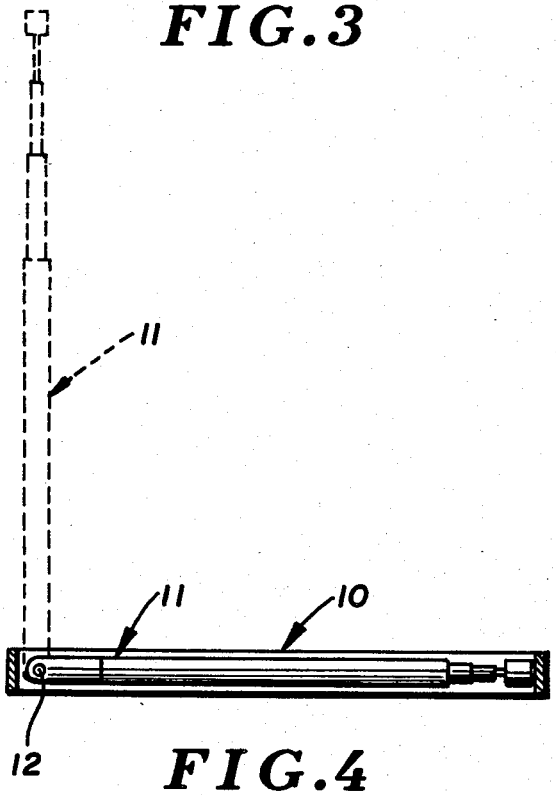
FIG. 4 is an elevation in section on the line 4—4 of FIG. 2 and in the direction of the arrows.

Preferably the handle 11 is pivotally attached to the inside of the hoop by an appropriate hinge structure 12. Preferably the handle is composed of a plurality of telescoping segments 11, 11A, 11B, etc., whose collapsed length is slightly less than the inside diameter of the hoop 10, such that for carrying, shipping or storage, the handle lies completely within the hoop, as shown in FIGS. 2 and 4. Handle 11 may be separable from hoop 10. For example, the hoop may be provided with a hinged or stationary socket into which the distal end of the handle may be inserted with a slide fit, or as shown in FIG. 2, the socket and handle end may be screw threaded for disengageable attachment.

In the use of the hosiery donning aid, the open top end of a sock or stocking 14 is stretched over the outside of the hoop in firm but readily separable engagement. The user of the aid, by means of the elongated handle, maneuvers the hoop and sock over the toes and pulls the sock or stocking over the foot and ankle until the resistance between the hosiery and the foot is greater than that between the hosiery and the hoop. Then the hoop pulls loose from the hosiery and is removed by sliding it downwardly over the now-covered foot, and the process is repeated for the other foot.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A device for aiding the infirm in donning hosiery, said device comprising:

(A) a rigid hoop of a size sufficiently large to permit the user's foot to fit loosely therein, said hoop having smooth inner and outer surfaces, the outer surface being engageable by the stretched open end of a sock or stocking, and (B) a single slender rigid elongated telescopic handle pivotally secured to the inside surface of one side of said hoop, the length of said handle when telescoped being less than the inside diameter of the hoop, whereby the handle may be collapsed within the hoop for storage of the device.

2. A device according to claim 1 wherein said handle is disengageable from said hoop.

* * * * *